US008783175B2

(12) United States Patent
Diews

(10) Patent No.: US 8,783,175 B2
(45) Date of Patent: Jul. 22, 2014

(54) METHOD FOR OPERATING AN ANILOX PRINTING UNIT AND PRINTING PRESS WITH AN ANILOX PRINTING UNIT

(75) Inventor: Michael Diews, Birkenau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 110 days.

(21) Appl. No.: 13/541,912

(22) Filed: Jul. 5, 2012

(65) Prior Publication Data

US 2013/0008327 A1 Jan. 10, 2013

(30) Foreign Application Priority Data

Jul. 6, 2011 (DE) ..... 10 2011 106 788

(51) Int. Cl.

| | |
|---|---|
| ***B41F 31/00*** | (2006.01) |
| ***B41F 31/04*** | (2006.01) |
| ***B41F 31/06*** | (2006.01) |
| ***B41F 9/10*** | (2006.01) |

(52) U.S. Cl.

USPC ..... 101/157; 101/159; 101/167; 101/169; 101/350.3; 101/350.5

(58) Field of Classification Search

USPC ..... 101/154, 157, 169, 350.5, 350.6, 351.1, 101/351.3, 352.01, 352.04, 352.13, 167, 101/350.3, 364, DIG. 34

See application file for complete search history.

(56) References Cited

U.S. PATENT DOCUMENTS

| | | | | |
|---|---|---|---|---|
| 5,297,490 | A * | 3/1994 | Schneider et al. | 101/365 |
| 5,848,570 | A | 12/1998 | Koppelkamm et al. | |
| 6,705,223 | B2 * | 3/2004 | Schonberger | 101/350.1 |
| 7,607,390 | B2 * | 10/2009 | Donath et al. | 101/352.13 |
| 8,205,550 | B2 * | 6/2012 | Binder et al. | 101/352.13 |
| 2002/0162466 | A1 * | 11/2002 | Schonberger | 101/350.3 |
| 2008/0127840 | A1 | 6/2008 | Binder et al. | |

FOREIGN PATENT DOCUMENTS

| | | | |
|---|---|---|---|
| DE | 10 2005 049 090 | A1 | 5/2006 |
| DE | 10 2005 029 970 | A1 | 1/2007 |
| DE | 10 2007 053 799 | A1 | 6/2008 |
| EP | 0 820 866 | A2 | 1/1998 |

* cited by examiner

*Primary Examiner* — Ren Yan
*Assistant Examiner* — Marissa Ferguson Samreth
(74) *Attorney, Agent, or Firm* — Laurence A. Greenberg; Werner H. Stemer; Ralph E. Locher

(57) ABSTRACT

A printing press includes an anilox printing unit having a screen roller and a feed blade as components, in which ink accumulates on an outer side of the feed blade during printing. A method for operating the anilox printing unit includes removing the accumulated ink from the feed blade by moving one of the two components relative to the other of the two components in a first direction in a first step, causing the accumulated ink to be flattened by the feed blade and to be spread onto the screen roller. The component that was moved in the first direction in the first step may be moved in an opposite, second direction in a second step, causing the accumulated ink to be scraped off the screen roller by the feed blade.

12 Claims, 3 Drawing Sheets

METHOD FOR OPERATING AN ANILOX PRINTING UNIT AND PRINTING PRESS WITH AN ANILOX PRINTING UNIT

CROSS-REFERENCE TO RELATED APPLICATION

This application claims the priority, under 35 U.S.C. §119, of German Patent Application DE 10 2011 106 788.8, filed Jul. 6, 2011; the prior application is herewith incorporated by reference in its entirety.

BACKGROUND OF THE INVENTION

Field of the Invention

The present invention relates to a method of operating an anilox printing unit including a screen roller and a feed blade as components, wherein ink accumulates on an outer side of the feed blade during printing. The invention further relates to a printing press including an anilox printing unit having a screen roller, a cooperating feed blade and a control device for controlling the screen roller, wherein the control device is programmed to rotate the screen roller in an operating direction during printing.

Ink fountains of anilox printing units include an operating or feed blade. If the ink fountain is a chambered doctor blade, the ink fountain additionally includes a closing blade. In general, the feed blade is negatively engaged with the screen roller and its inner side delimits the ink supply stored in the ink fountain.

U.S. Pat. Nos. 7,398,731 and 7,607,390 disclose anilox printing units with doctor-type ink fountains and chambered doctor blades.

During operation, it is impossible to prevent ink from accumulating on the lower or outer side of the feed blade. Those ink accumulations take the shape of drops or a bead and may be referred to as an ink beard. When the accumulated ink has grown to a certain size, it may detach from the feed blade in an uncontrolled way and may get onto the screen roller, where it may cause undesired ink density fluctuations on the printing stock.

In order to avoid that problem, German Patent Application DE 10 2005 029 970 A1 proposes to provide a collecting container underneath a chambered doctor blade in order to collect the ink dripping from an operating blade and to align the operating blade in such a way as to ensure that the emerging drops of ink run down the outer side of the operating blade into the collecting container due to gravity.

However, that system only works reliably for inks with comparatively low viscosity. High-viscosity inks tend to stick to the lower side of the blade without running off. In addition, the ink collected in the collecting container dries up and is therefore wasted.

German Patent Application DE 10 2007 053 799 A1, corresponding to U.S. Patent Application No. US 2008/0127840, discloses a different apparatus which permits the accumulated ink to detach from the feed blade. Having detached and gotten onto the screen roller, the accumulated ink is flattened or smoothened on the screen roller through the use of a smoothening device. Once the accumulated ink has been smoothened, it may pass through an open roller nip formed by the screen roller and an ink form roller without contacting the ink form roller. Thus, the accumulated ink is conveyed back into the ink fountain by the screen roller.

That system requires the presence of the additional smoothening device, which may be a smoothening blade or a smoothening roller. Thus, the system has a comparatively complex construction.

SUMMARY OF THE INVENTION

It is accordingly an object of the invention to provide a method for operating an anilox printing unit and a printing press with an anilox printing unit, which overcome the hereinafore-mentioned disadvantages of the heretofore-known methods and devices of this general type and which are easy to implement from a structural point of view.

With the foregoing and other objects in view there is provided, in accordance with the invention, a method for operating an anilox printing unit. The method comprises providing a screen roller and a feed blade as two components, the feed blade having an outer side accumulating ink thereon during printing, and removing the accumulated ink from the feed blade by moving one of the two components relative to the other of the two components in a first direction in a first step, causing the accumulated ink to be smoothened and spread onto the screen roller by the feed blade.

The first step is not carried out during an ongoing printing operation but rather outside of the printing operation.

The method of the invention advantageously proposes to use the feed blade, which is present in any case, to smoothen the accumulated ink and is thus easy to implement. An additional smoothening device is not necessary.

An additional advantage is that the method can also be used with printing inks of comparatively high viscosity.

In accordance with another mode of the invention, the relative movement between the two components in the first step is achieved by rotating the screen roller in the first direction. The first direction may be opposite the direction of rotation of the screen roller during printing operation. By rotating the screen roller relative to the feed blade in the first direction or counter-direction, the accumulated ink may be conveyed out of a circumferential screen roller region located underneath the feed blade and past the feed blade into a circumferential screen roller region located above the feed blade.

In accordance with a further mode of the invention, an edge of the feed blade or a feed blade front portion equipped with a cutting edge is bent away from the screen roller by the accumulated ink as the ink is being flattened. During printing, the feed blade operates as a blade that is engaged with the screen roller at a negative angle of engagement. Once the direction of movement of the component has been changed, e.g. once the direction of rotation of the screen roller has been changed, the feed blade operates as a positive blade when it spreads and smoothens the accumulated ink. Due to the reverse rotation of the screen roller, the accumulated ink, which is urged into the wedge-shaped region between the lower side of the feed blade and the circumferential surface of the screen roller, slightly pushes the feed blade away from the screen roller. In the process, the non-clamped front portion of the feed blade is slightly bent due to its flexibility.

In accordance with an added mode of the invention, in a second step, that component that was moved in the first direction in the first step is moved relative to the other of the two components in an opposite, second direction. Thus, the accumulated ink is scraped off the screen roller by the feed blade. If, in the first step, the feed blade was moved relative to the screen roller, which was able to remain in position in terms of its angle of rotation, the feed blade is moved relative to the screen roller in the second step and is thus returned to its initial position, e.g. the operating position, of the feed blade. The oscillating movement of the feed blade carried out in the two steps may be either along a straight path parallel to a tangent to the screen roller, or along an arcuate path concentric with the circumference of the screen roller. The feed blade may be moved relative to the screen roller together with an ink fountain to which the feed blade may be attached. If, in the first step, the screen roller was rotated relative to the feed blade, in the second step the screen roller is again rotated relative to the feed blade.

In accordance with an additional mode of the invention, the relative movement between the two components in the second step is achieved by rotating the screen roller in the second direction, and the screen roller is likewise rotated in the second direction during printing. After the accumulated ink has been detached from the feed blade by the temporary reverse rotation of the screen roller and sticks to the screen roller in the circumferential region thereof that is above the feed blade, the direction of rotation is reversed again. As a result of this reversal of direction, the screen roller once again rotates in the same direction as during printing and the accumulated ink is taken off the screen roller by the feed blade.

In accordance with yet another mode of the invention, an edge of the feed blade rests against the screen roller when the accumulated ink is scraped off the screen roller and the accumulated ink that has been scraped off runs down an inner side of the feed blade and into an ink fountain. The inner side is that surface that delimits an ink supply in the ink fountain during printing, thus it is the feed blade side that faces away from the screen roller. As the accumulated ink runs along the inside of the feed blade, the accumulated ink travels to the ink fountain and into the ink supply located therein. Thus, the accumulated ink is not wasted and can advantageously be used for printing.

In accordance with yet a further mode of the invention, the screen roller only rotates through a small angle during its rotation in the first direction. The screen roller rotates through less than a complete revolution (360°), especially through less than half of a revolution (180°), in particular through less than a quarter of a revolution (90°), especially through less than one eighth of a revolution (45°). The corresponding angle of rotation may, for instance, be 20°.

With the objects of the invention in view, there is concomitantly provided a printing press, comprising an anilox printing unit including a screen roller and a cooperating feed blade having an outer side, and a control device configured for controlling the screen roller. The control device is programmed to rotate the screen roller in an operating direction during printing. The control device is programmed to rotate the screen roller in a direction opposite to the operating direction in a first step and to rotate the screen roller in the operating direction again in a second step, upon a removal of accumulated ink from the outer side of the feed blade.

In accordance with further embodiments, the program may implement an algorithm that envisages an automatic removal of accumulated ink at predetermined intervals. The automatic implementation of the first step and of the second step may occur at regular intervals, for instance every three hours, or at defined instants, for instance between two successive print jobs. However, the program may likewise envisage manual initiation of the implementation of the first and second steps. In such a case, the program verifies whether or not the operator has initiated the removal of the accumulated ink at least once within a given period of three hours, for example. The initiation may be done by pressing a button, for instance. If it is found that the time that has elapsed since the last removal of accumulated ink is longer than the given interval, which is three hours in the present example, and that there is consequently a risk that the accumulated ink may have dried onto the feed blade, thus causing an automatic removal to be prone to complications, the program blocks the initiation of the automatic removal and informs the operator of that fact on a display, for instance. The aforementioned complications may be that during the removal, the ink that has dried on gets into the fresh printing ink in the ink fountain. During printing, the ink may then clot the depressions (cells) of the screen roller, which would cause defects in the printed image.

Other features which are considered as characteristic for the invention are set forth in the appended claims.

Although the invention is illustrated and described herein as embodied in a method for operating an anilox printing unit and a printing press with an anilox printing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
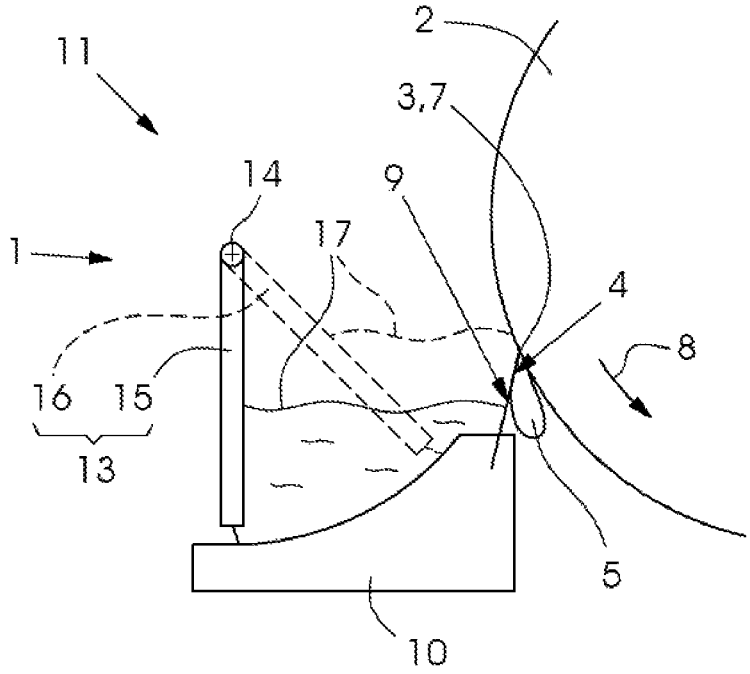
FIG. 1 is a diagrammatic, side-elevational view of an ink fountain with a feed blade having accumulated ink sticking to its outer side.

Referring now in detail to the figures of the drawings, in which like components and elements are designated by like reference numerals, and first, particularly, to FIG. 1 thereof, there is seen a section of a sheet-fed printing press 11 for lithographic or planographic offset printing. The illustrated section includes a screen roller 2 and an ink fountain 10 of an anilox printing unit 1 of the printing press 11. The ink fountain 10 includes a rear wall 13 and a feed blade 3 with an edge 7. The screen roller 2 and the feed blade 3 thus are components of the anilox printing unit 1.

The rear wall 13 is mounted in a pivot joint or hinge 14 and is adjustable between a first position 15, which is illustrated in full lines, and a second position 16, which is illustrated in phantom lines. During printing, the rear wall 13 is in the second position 16, in which it limits an ink supply present in the ink fountain 10 in such a way as to ensure that a fill level 17 is above the edge 7. During service and maintenance operations, the rear wall is in the first position 15, in which the fill level 17 of the ink supply is below the edge 7. The second position 16 of the rear wall 13 is closer to the feed blade 3 and to the screen roller 2 than the first position 15.

During operation, the feed blade 3 is in negative engagement with the screen roller 2 and has an outer side 4 and an inner side 9.

Figure 4:
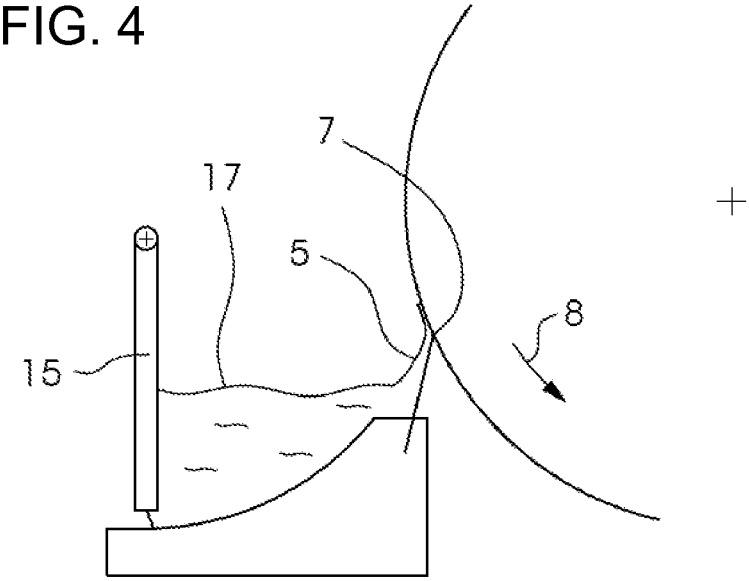
FIG. 4 is a side-elevational view illustrating the feed blade as the accumulated ink is scraped off the screen roller.
Figure 5:
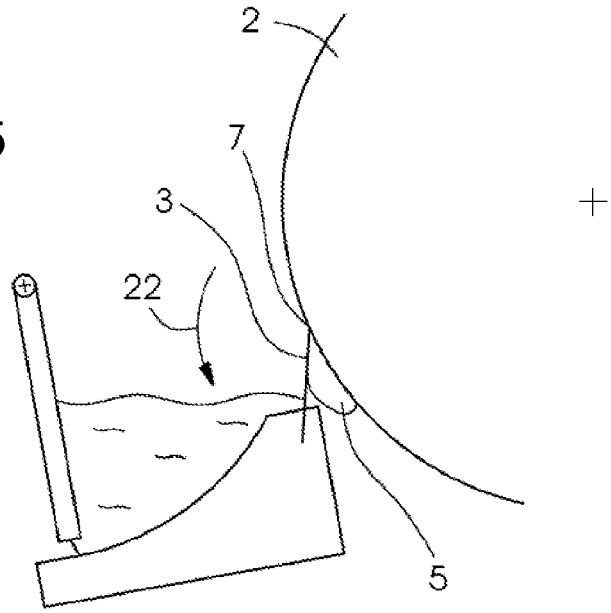
FIG. 5 is a side-elevational view illustrating the ink fountain and the feed blade as the accumulated ink is spread onto the screen roller in an alternative way compared to FIG. 2.
Figure 6:
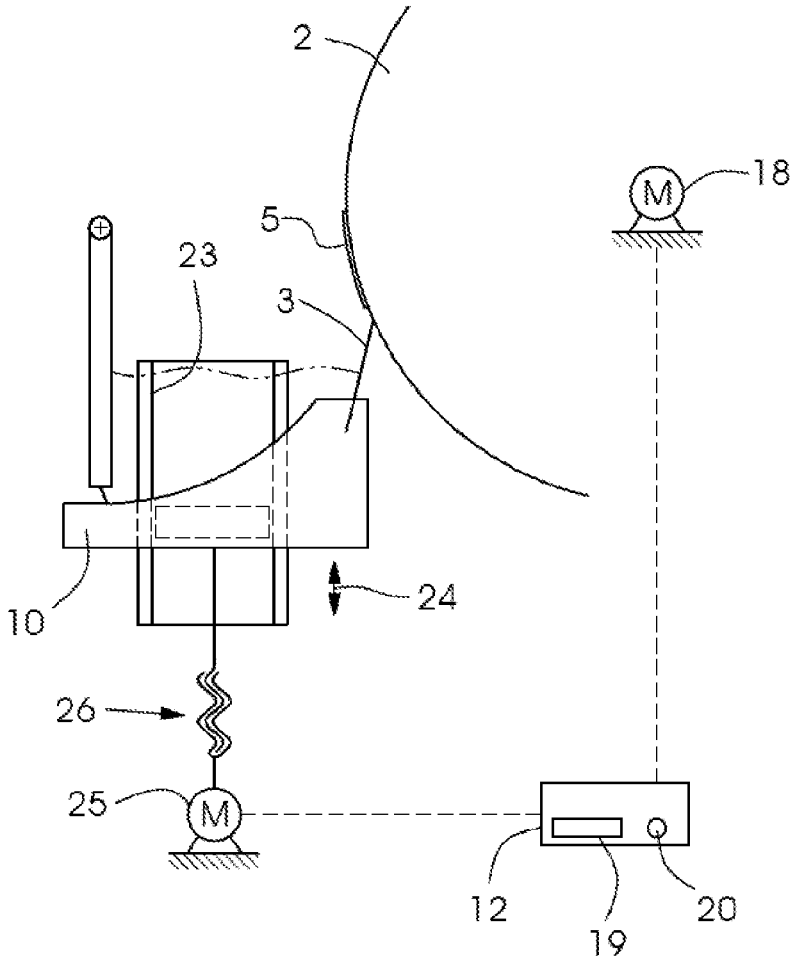
FIG. 6 is a side-elevational view of an alternative embodiment in which the ink fountain and the feed blade are displaced linearly along the screen roller, which does not rotate, as the accumulated ink is spread on and scraped off.

FIG. 6 illustrates further components that are likewise present in the embodiments shown in FIGS. 1 to 5. A programmable electronic control device 12 controls a first motor 18 that rotates the screen roller 2 in a first direction 6 (see FIG. 2) for maintenance and service operations and in a second direction 8 (see FIG. 1) during printing.

All of the embodiments have in common that during printing, the rear wall 13 is in the advanced, second position 16. Consequently, the fill level 17 of the ink supply is above the edge 7 as indicated by the phantom lines in FIG. 1. The ink supply is thus delimited by the circumferential surface of the screen roller 2, against which the feed blade 3 rests during printing. Since the ink supply is in contact with the screen roller 2, depressions (cells) formed therein, for instance cups or grooves, are filled with printing ink from the ink supply. The feed blade 3 scrapes off excess ink from the circumferential surface of the screen roller 2. In the process, it is impossible to prevent ink from leaking between the feed blade 3 and the screen roller 2. Leaking ink 5 accumulates on the outer side 4 of the feed blade 3 in the shape of a drop, thread, or bead and may be referred to as an ink beard.

A particularly critical phase of operation is when the anilox printing unit 1 is restarted and the screen roller 2 starts to rotate again after a standstill of the machine or an interruption of the printing operation. In such a case, the accumulated ink 5 may detach from the outer side 4 and may be entrained by the screen roller 2. In order to counteract that danger, the control device 12 (see FIG. 6) by default activates a cleaning program prior to a restart. In addition, a button 20 may be provided on the control device 12 for use by the operator to initiate the cleaning program as desired. The button 20 may be an element on a touch screen or a push button, for example.

In accordance with the program, firstly the rear wall 13 is moved from the second position 16 to the first position 15 in order to lower the fill level 17 below the top point of the feed blade 3 or below the edge 7. The adjustment of the rear wall 13 may be done automatically using an actuating drive or manually by the operator, for instance after a prompt by the control device 12 on a display 19 (see FIG. 6). Once the fill level 17 has been lowered, the rotation of the screen roller 2 in the second direction 8 is stopped.

The features described above apply to all embodiments. In the following, the different embodiments will be individually explained in more detail.

Figure 2:
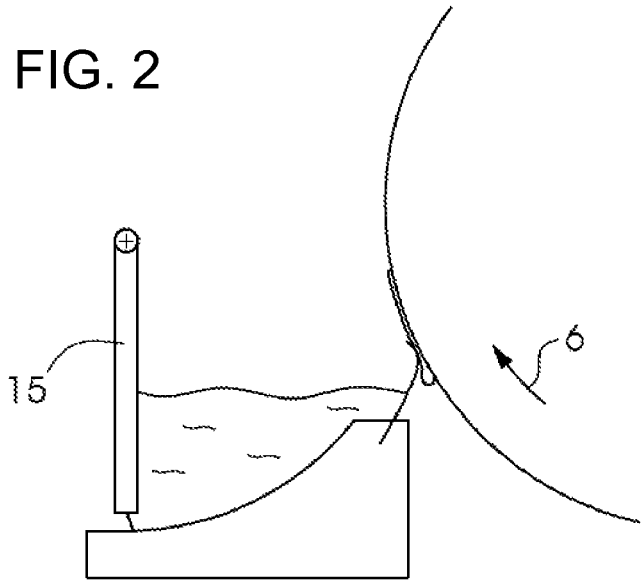
FIG. 2 is a side-elevational view of the ink fountain and the feed blade as the accumulated ink is being spread onto a screen roller.

In the embodiment shown in FIGS. 1 to 4, the next program step is to rotate the screen roller 2 through an angle of rotation of 2° to 5° in the first direction 6 as shown in FIG. 2. As a consequence, the accumulated ink 5 is transferred from the feed blade 3 to the screen roller 2 and is transported upward past the edge 7 as it adheres to the screen roller. In the process, the accumulated ink 5 is smoothened or flattened by the feed blade 3 and slightly urges the front portion of the feed blade 3 away from the screen roller 2.

Figure 3:
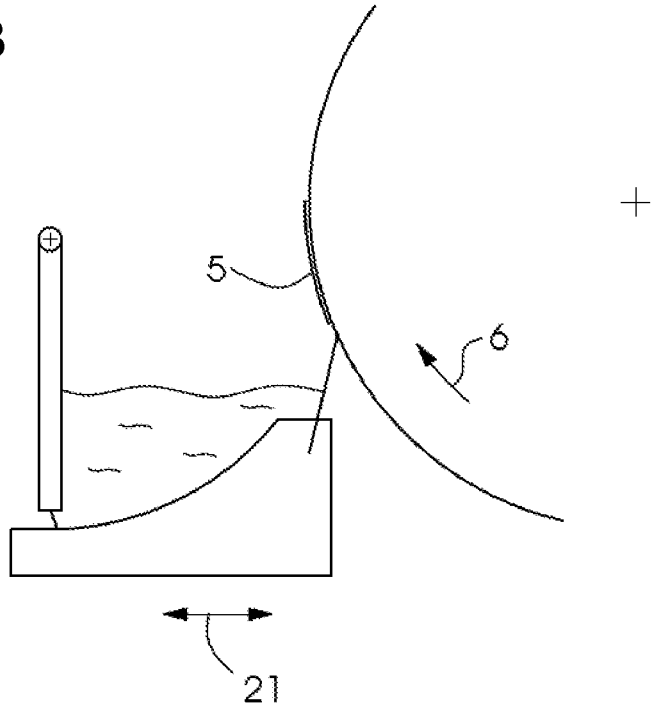
FIG. 3 is a side-elevational view illustrating a movement of the ink fountain together with the feed blade away from the screen roller.

As is shown in FIG. 3, the ink fountain 10 and the feed blade 3 are moved away from the screen roller 2 to reduce and virtually remove the pressure that the feed blade 3 applies to the screen roller 2. The horizontal retraction of the ink fountain 10 and the feed blade 3 away from the screen roller 2 is achieved through the use of an actuating device, which is symbolically illustrated by an arrow 21. Due to this relaxation of the flexible feed blade 3, the accumulated ink 5 that is conveyed past the feed blade 3 is smoothened or flattened to a lesser extent in the course of the continued rotation of the screen roller. After a rotation through an angle of approximately 20°, all of the accumulated ink is above the feed blade 3 or rather above its edge 7. Then the first motor 18 stops the screen roller 2. In a further step, the actuating device (arrow 21) returns the feed blade 3 to the screen roller 2 to reengage it with the latter under an inherent resilient stress of the feed blade 3.

As is shown in FIG. 4, in a further step, the first motor 18 is actuated by the control device 12 to rotate the screen roller 2 in the second direction 8. Thus, the accumulated ink 5, which now adheres to the screen roller 2, is moved towards the feed blade 3. Due to the negative angle of engagement of the feed blade 3 and due to the firm engagement between the edge 7 and the screen roller 2, the feed blade 3 scrapes off the accumulated ink 5 from the screen roller 2 as the accumulated ink 5 is moved downward. In the process, the accumulated ink 5 that has been scraped off runs over the inner (rear) side 9 into the ink fountain 10, where it mixes with the ink supply present in the ink fountain 10.

There is an important difference between the operation of the ink fountain 10 as the accumulated ink 5 is scraped off as shown in FIG. 4 and the operation of the ink fountain 10 during printing: during printing, the rear wall 13 is in the second position 16 and the fill level 17 is elevated to a line above the tip of the blade (edge 7). When the accumulated ink 5 is scraped off, the rear wall 13 is in its first position 15 and the fill level 17 is lowered below the tip of the blade.

In accordance with a non-illustrated modification, the steps of disengaging and engaging the feed blade 3 and of reversing and advancing the screen roller 2 as shown in FIGS. 2 to 4 are repeated once or several times.

FIG. 5 illustrates an embodiment that only differs from the one shown in FIGS. 1 to 4 in the fact that the movement that presses the accumulated ink 5 onto the screen roller 2 is a pivoting movement 22. The center or pivot axis of the pivoting movement 22 is the edge 7 or its point of contact with the circumferential surface of the screen roller 2. The downward pivoting movement 22 of the ink fountain 10 and the feed blade 3 about the edge 7 causes the accumulated ink 5 to be pressed against the circumferential surface of the screen roller 2 and thus to adhere to the circumferential surface of the screen roller 2. When the ink fountain 10 and the feed blade 3 have been pivoted back up, the steps illustrated in FIGS. 2 to 4 may be carried out to remove the accumulated ink 5 that aThat is to say, in this figure, the screen roller 2 likewise rotates backward in the first direction 6 and rotates forward in the second direction 8.

In the exemplary embodiment shown in FIG. 6, the ink fountain 10 is adjustably mounted in a linear guide 23. A second motor 25 is provided as an actuating drive that moves the ink fountain 10 and the feed blade 3 along the linear guide 23. The ink fountain 10 carries out a reciprocating translatory movement 24 that is parallel to an imaginary tangent to the circumferential surface of the screen roller. The translatory movement 24 is preferably a vertical movement. The second motor 25 may drive the ink fountain 10 through a gearing mechanism 26, for instance a worm gearing. The control device 12 controls the second motor 25 in accordance with the program that runs in the control device 12 (see FIG. 1) for removing the accumulated ink 5 as the second motor 25 drives the translatory movement 24. Due to the curvature of the circumferential surface of the screen roller, the feed blade 3 is elastically bent to different extents in the course of the reciprocating translatory movement 24. The contact pressure applied by the feed blade 3 to the screen roller 2 changes in the course of the translatory movement 24. During the downward part of the translatory movement 24, the feed blade 3 may lose contact with the screen roller 2. Thus, the accumulated ink 5 on the screen roller 2 is spread onto the screen roller 2, as is the case with the embodiment shown in FIGS. 1 to 4. During the upward part of the translatory movement, the feed blade 3 scrapes the accumulated ink 5 off the screen roller 2.

The embodiment shown in FIG. 6 may additionally include an actuating device 21 (see FIG. 3). Together, the actuating device 21 and the linear guide 23 may form a form of cross slide.

The invention claimed is:

1. A method for operating an anilox printing unit, the method comprising the following steps:

providing a screen roller and a feed blade as two components, the feed blade having an outer side accumulating ink thereon during printing;

removing the accumulated ink from the feed blade by moving one of the two components relative to the other of the two components in a first direction in a first step, causing the accumulated ink to be smoothened and spread onto the screen roller by the feed blade; and moving the component having been moved in the first direction in the first step in an opposite, second direction relative to the other of the two components in a second step, causing the accumulated ink to be scraped off the screen roller by the feed blade.

2. The method according to claim 1, which further comprises carrying out the relative movement between the two components in the first step by rotating the screen roller in the first direction.

3. The method according to claim 2, which further comprises rotating the screen roller in the first direction through less than 360°.

4. The method according to claim 2, which further comprises rotating the screen roller in the first direction through less than 180°.

5. The method according to claim 2, which further comprises rotating the screen roller in the first direction through less than 90°.

6. The method according to claim 2, which further comprises rotating the screen roller in the first direction through less than 45°.

7. The method according to claim 1, which further comprises bending an edge of the feed blade away from the screen roller due to the accumulated ink as the accumulated ink is spread onto the screen roller.

8. The method according to claim 1, which further comprises carrying out the relative movement between the two components by rotating the screen roller in the second direction, and rotating the screen roller in the second direction during printing.

9. The method according to claim 1, which further comprises, during the step of scraping the accumulated ink off the screen roller, resting an edge of the feed blade against the screen roller and causing the accumulated ink to run across an inner side of the feed blade into an ink fountain.

10. The method according to claim 1, which further comprises moving the feed blade relative to the screen roller.

11. The method according to claim 10, which further comprises moving the feed blade together with an ink fountain relative to the screen roller.

12. A printing press, comprising:

an anilox printing unit including a screen roller and a cooperating feed blade having an outer side; and a control device configured for controlling said screen roller;

said control device being programmed to rotate said screen roller in an operating direction during printing; and said control device being programmed to rotate said screen roller in a direction opposite to said operating direction in a first step and to rotate said screen roller in said operating direction again in a second step, upon a removal of accumulated ink from said outer side of said feed blade.

* * * * *